US005899350A

United States Patent [19]

Itoh et al.

[11] Patent Number: 5,899,350

[45] Date of Patent: May 4, 1999

[54] HERMETIC CONTAINER AND A SUPPORTING MEMBER FOR THE SAME

[75] Inventors: Shigeo Itoh; Yoshio Makita; Kenichi Honda; Tatsuo Yamaura, all of Mobara, Japan

[73] Assignee: Futaba Denshi Kogyo K.K., Mobara, Japan

[21] Appl. No.: 09/012,574

[22] Filed: Jan. 23, 1998

[30] Foreign Application Priority Data

Jan. 29, 1997 [JP] Japan ..... 9-015377

[51] Int. Cl.[6] ..... H01K 1/36

[52] U.S. Cl. ..... 220/2.3 R; 220/2.1 R

[58] Field of Search ..... 220/2.1 R, 2.2, 220/2.3 R, 2.3 A, 2.1 A

[56] References Cited

U.S. PATENT DOCUMENTS

| | | | |
|---|---|---|---|
| 3,109,225 | 11/1963 | Wright et al. | 220/2.3 R |
| 3,190,952 | 6/1965 | Bitko | 220/2.3 R |
| 3,536,964 | 10/1970 | Lob et al. | 220/2.3 R |
| 3,923,189 | 12/1975 | Faulkner | 220/2.3 R |
| 4,325,489 | 4/1982 | Russell et al. | 220/2.3 R |

*Primary Examiner*—Joseph M. Moy

*Attorney, Agent, or Firm*—Oblon, Spivak, McClelland, Maier & Neustadt, P.C.

[57] ABSTRACT

A hermetic container which can improve its stress resistance and its buckling strength and prevent deformation due to the atmospheric pressure. The space between the anode substrate and the cathode substrate in the hermetic container can be stably maintained. Anode conductors and fluorescent substance layers are formed on the inner surface of the anode substrate. Electron sources are formed on the inner surface of the cathode substrate so as to confront the corresponding display portions on the anode substrate. In order to complete a container, the anode substrate is spaced from the cathode substrate a predetermined distance apart and the fringe portions of the substrates are sealed. A supporting member is disposed in the container. The supporting member 15 consists of a plate in which plural through holes are formed at predetermined intervals and reinforcing supports which are respectively inserted into the through holes of the plate and of which the middle portions are bonded at the inlets of the through holes. Each reinforcing support has one end in contact with an inner surface of the anode substrate and the other end in contact with an inner surface of the cathode substrate. Each reinforcing support maintains the gap between the anode substrate and the cathode substrate at a fixed distance.

8 Claims, 6 Drawing Sheets

HERMETIC CONTAINER AND A SUPPORTING MEMBER FOR THE SAME

BACKGROUND OF THE INVENTION

1. Field of the Invention

This invention relates to a hermetic container and to a supporting member which supports the inner surfaces of the hermetic container against the atmospheric pressure to prevent deformation of the hermetic container.

2. Description of the Related Art

A field-emission-type display device hereinafter referred to as a FED) which uses a field emission cathode acting as an electron source is well-known as a hermetic container of which the inside is maintained in a high vacuum state. In the FED shown in FIG. 5, an anode substrate 32 is sealed with respect to a cathode substrate 34 spaced from the anode substrate a predetermined distance apart and at the fringe portions of them to form the container 35. The anode substrate 32 has the inner surface on which anode conductors 31*a* and fluorescent substance layers 31*b* are formed. The cathode substrate 34 has the inner surface on which field emission cathodes are formed so as to confront the display section 31 on the anode substrate 32.

In this type of FED, the anode substrate 32 on which the display sections 31 are arranged in a fine dot pattern is formed of a thin glass plate. The cathode substrate 34 on which field emission cathodes 33 are formed is formed of a thin glass plate. The space between the anode substrate 32 and the cathode substrate 34 is, for example, 200 $\mu$m to realize a thin display structure.

In the type of FED, since the space between the anode substrate 32 and the cathode substrate 34 is maintained by only the fringe portions of them, the mechanical strength is secured by thickening the anode substrate 32 and the cathode substrate 34.

However, as the FED is large sized, the anode substrate 32 and the cathode substrate 34 forming the container 35 must be thickened to withstand the external pressure and to realize a thin, light filed emission type display. Deformation of the anode substrate 32 or the cathode substrate 34 makes it difficult to maintain the space between the anode substrate 32 and the cathode substrate 34 to a fixed value, thus adversely affecting the display conditions. For that reason, as shown in FIG. 5, fiber supports each formed of a glass member and bead supports each formed of glass member acting as a reinforcing support are arranged at plural spots within the container 35. Thus, the supports bear against the atmospheric pressure on the container 34 to maintain the space between the anode substrate 32 and the cathode substrate 34.

The reinforcing supports (or pillars) 36 are arranged within the container 34 by using the dedicated jig 37 shown in FIG. 6. The jig 37, as shown in FIG. 6, includes a base plate 38 and a suction apparatus 40. The base plate 38 has through holes 38*a* which are formed at the corresponding positions where reinforcing supports 36 for the substrates 32 and 34 are arranged. The base plate 38 is closely disposed on the surface of the porous portion 39. The suction apparatus 40 sucks the reinforcing supports 36 respectively inserted into the through holes 38 through the porous portion 39 to hold them on the surface of the porous portion 39.

In order to arrange the reinforcing supports 36 within the container 35, the reinforcing supports 36 are inserted into the through holes 38*a* from the side of the other end surface 36*b* of each reinforcing support. In such a condition, the suction apparatus 40 sucks and holds the other surface 36*b* of each reinforcing support 36 through the porous portion 39, so that plural reinforcing supports 36 are arranged while being inserted into the through holes 38*a*. In this case, a fixing agent 41 is previously applied on one ends 36*a* of the reinforcing supports 36.

In the arrangement process, the reinforcing supports 36 are disposed on the anode substrate 32 and one ends 36*a* thereof are securely fixed with the fixing agent 41 under pressure. Thereafter, the anode substrate 32 on which reinforcing supports 36 are securer fixed are removed out of the jig 37. A fixing agent 2 is coated on the other end surfaces 36*b* of the reinforcing supports 36 and over the fringe portion of the anode substrate 32. The other end surfaces 36*b* of the reinforcing supports 36 are fixed on the cathode substrate 34 while the fringe portion of the anode substrate 32 is hermetically sealed with the fringe portion of the cathode substrate 34.

As described above, the reinforcing supports 36 are arranged using the jig 37 while the other ends of the reinforcing supports 36 are being sucked and held. Hence, by using reinforcing supports each having a small aspect ratio (a ratio of diameter to length), for example, (an aspect ratio of 50 $\mu$m in diameter to 200 $\mu$m in length), the reinforcing supports 36 sucked and held can be arranged with a small positional deviation and a small error with respect to the center of the other end surface 36*b* of each reinforcing support 36 when one ends surfaces 36 of the reinforcing supports 36 are forcibly disposed on the substrate.

However, the high resolution display restricts the area where the reinforcing supports are arranged, thus causing a reduction in diameter of the reinforcing support and an increase in the number of reinforcing supports. Moreover, In order to drive the field emission type display device at a high anode voltage, the spacing between the substrates 32 and 34 must be increased. This means that reinforcing supports with a large aspect ratio (for example, 50 $\mu$m in diameter and 1 mm in length) are disposed between the substrates 32 and 34.

In the conventional structure, when the anode substrate 36 is supported on one end surfaces 36*a* of the reinforcing supports 36 under pressure, it largely deviates from the other end surfaces 36*b* thereof to be sucked and held acting as the positional center. As a result, it is difficult to arrange the reinforcing supports 36 with small errors and to fabricate a field emission type display. When the atmospheric pressure are added to the substrates 32 and 34, the reinforcing supports 36 arranged within the container 35 with large errors may be bent or broken. Therefore the conventional structure is poor in stress resistance and buckling strength so that the space between the substrates 32 and 34 cannot be stably maintained.

Where bead supports are used as reinforcing supports, the diameter thereof corresponds to the space between the substrates 32 and 34. Increasing the size of the bead support means increasing the whole volume thereof. A large bead support blocks electron beams falling onto the display surface so that the electron beams cannot effectively strike the display surface. As a result, the vignetting of electron beams causes due to the bead support so that the diameter of a bead support that can be used for a high resolution display is restricted. This further limits the anode voltage to be applied. Consequently, there is the disadvantage in that the luminous brightness of the field emission type display cannot be improved.

SUMMARY OF THE INVENTION

The present invention is made to overcome the above-mentioned problems. The object of the invention is to provide a hermetic container supporting member that can provide its improved stress resistance and its improved buckling strength and can stably maintain the space between an anode substrate and a cathode substrate and can prevent deformation of the container by the atmospheric pressure.

Another object of the present invention is to provide a hermetic container including the supporting member.

According to the present invention, a hermetic container supporting member contained and arranged in a hermetic container to support on the inside of the hermetic container, comprises a plate having plural through holes arranged at a predetermined intervals and through windows each passing electrons; and reinforcing supports respectively inserted into the through holes, each of the reinforcing supports having an axial center portion securely fixed at a corresponding through hole and both ends being in contact with inner surfaces of the hermetic container.

According to the present invention, a hermetic container supporting member contained and arranged in a hermetic container to support on the inside of the hermetic container, the hermetic container containing an anode substrate having an inner surface on which a display portion is formed and a cathode substrate having an electron source on the inner surface confronting the display portion of the anode substrate, the anode substrate being spaced from the cathode substrate a predetermined distance apart, the anode substrate and the cathode substrate being sealed at the fringe portions of the anode and cathode substrates, comprises a plate having plural through holes arranged at predetermined intervals and through windows each passing electrons emitted from a corresponding electron source; and reinforcing supports respectively inserted into the through holes, each of the reinforcing supports having an axial center portion securely fixed at a corresponding through hole and both ends being in contact with an inner surface of the anode substrate and an inner surface of the cathode substrate.

In the hermetic container supporting member according to the present invention, the plate comprises an insulating member, the plate on which strip electrodes are formed on at least one surface thereof so as to sandwich a corresponding through window, the strip electrodes focusing and diverging electrons emitted from an electron source when an electric field is applied between strip electrodes. In the hermetic container supporting member according to the present invention, the plate comprises a metal member.

In the hermetic container supporting member according to the present invention, the plate partially comprises an alloy containing Zr, or has an alloy film containing Zr on the surface thereof.

According to the present invention, a hermetic container comprises an anode substrate having an inner surface on which an anode conductor and a display portion of a fluorescent substance layer are formed; a cathode substrate having an inner surface on which field emission cathodes are formed, the inner surface confronting the display portion on the anode substrate, the cathode substrate being spaced from the anode substrate a predetermined distance apart, the anode substrate and the cathode substrate being sealed at the fringe portions of the anode and cathode substrates; and a supporting member arranged between the anode substrate and the cathode substrate; the supporting member including a plate and reinforcing supports, the plate having plural through holes arranged at predetermined intervals and through windows each passing electrons emitted from a corresponding field emission cathode, and the reinforcing supports respectively inserted into the through holes, each of the reinforcing supports having an axial center portion securely fixed at a corresponding through hole and both ends being in contact with an inner surface of the anode substrate and an inner surface of the cathode substrate.

The above and other objects, features and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
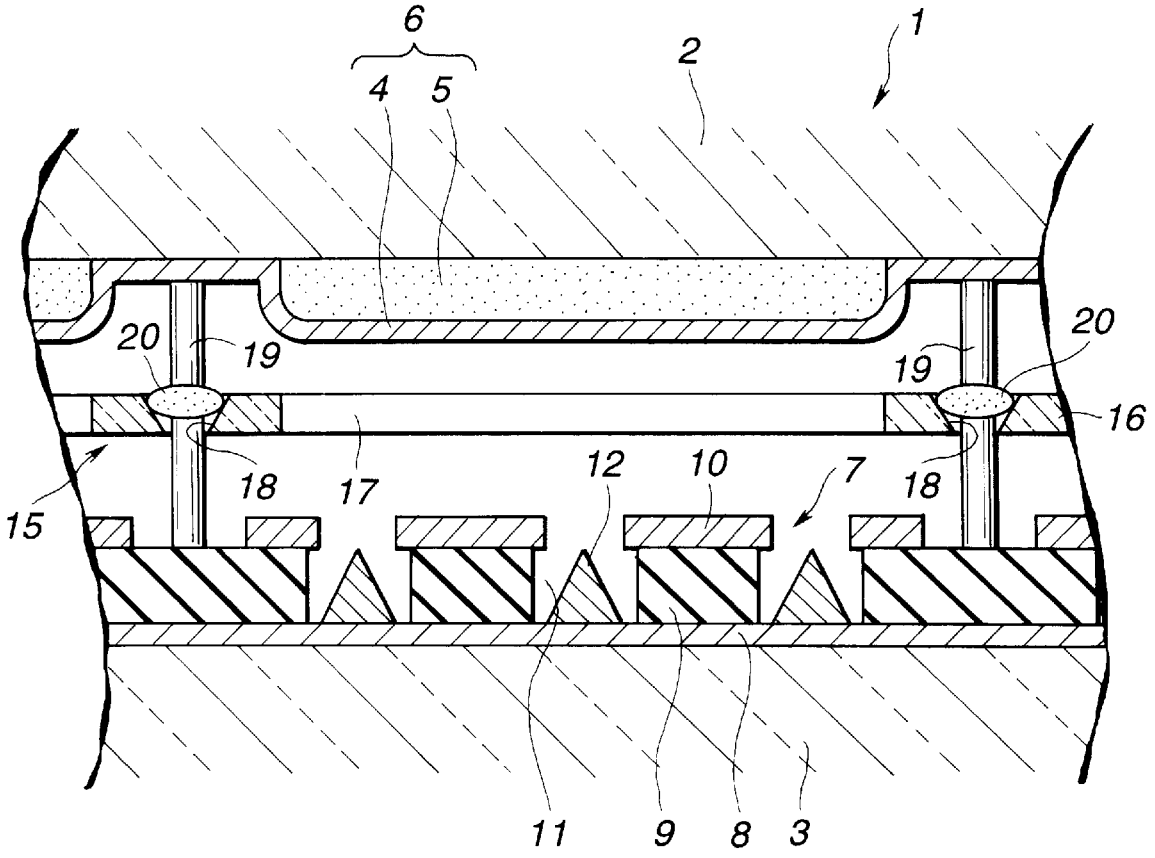
FIG. 1 is a side cross-sectional view partially illustrating the hermetic container of a field-emission-type display according to the first embodiment of the present invention.
Figure 2:
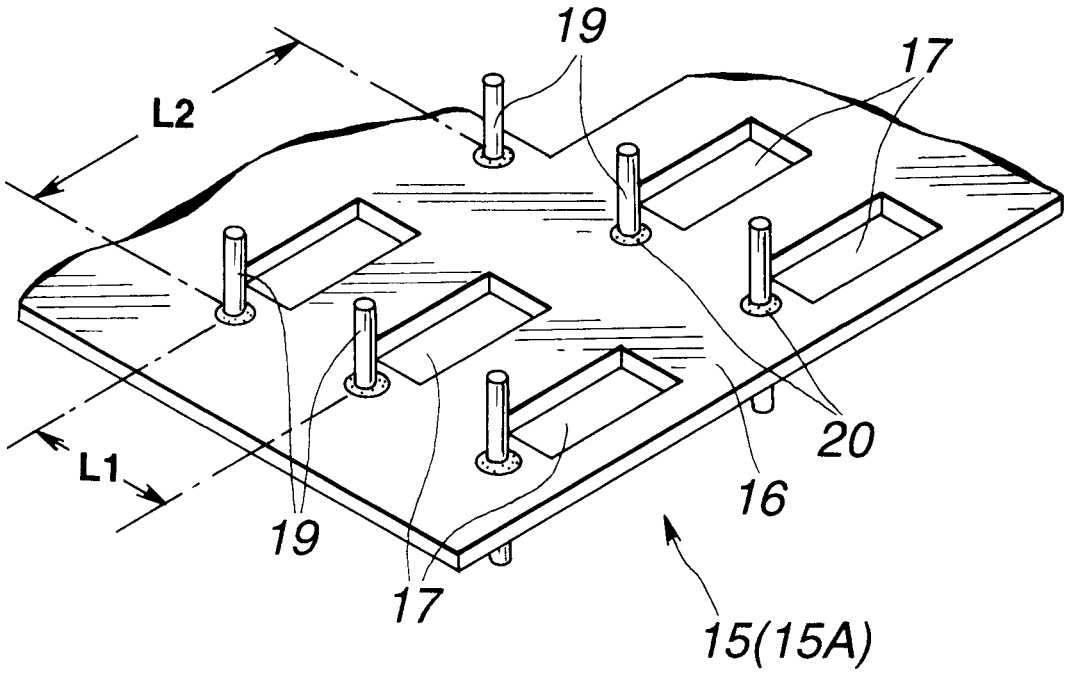
FIG. 2 is an enlarged perspective view partially illustrating the supporting member arranged in the hermetic container of a field-emission-type display according to the first embodiment of the present invention shown in FIG. 1.
Figure 3A:
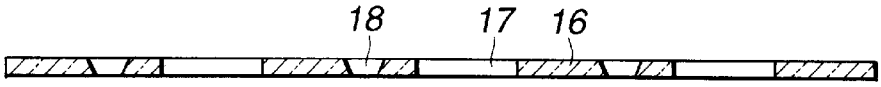
FIGS. 3(*a*) to 3(*e*) are cross sectional views each illustrating a step of fabricating the supporting member for a hermetic container according to the first embodiment of the present invention.
Figure 3B:
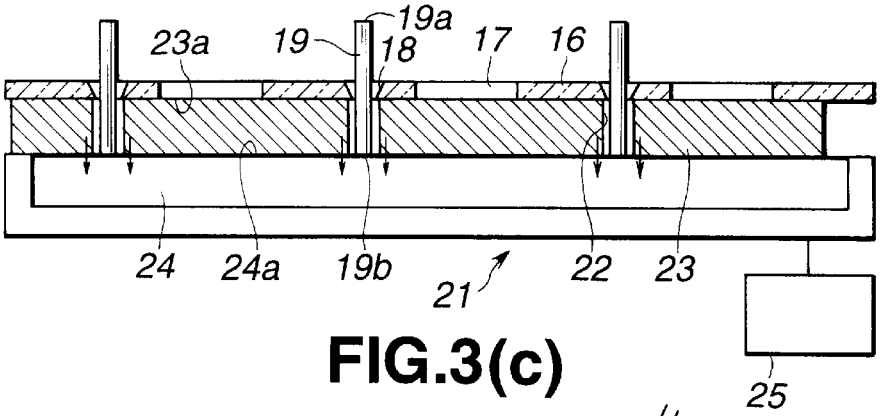
Figure 3C:
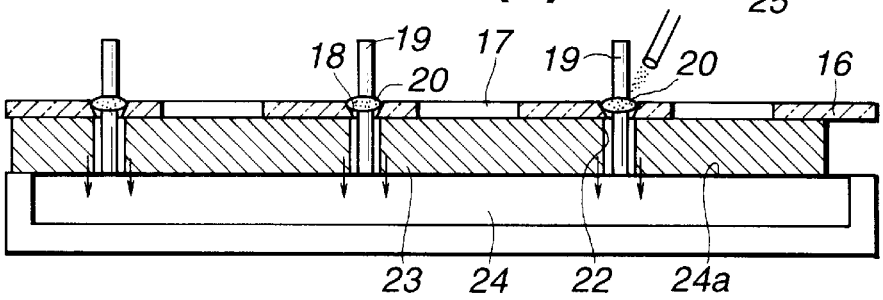
Figure 3D:
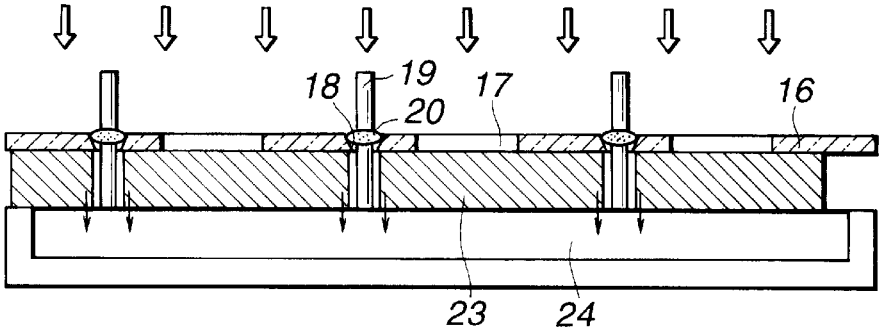
Figure 3E:
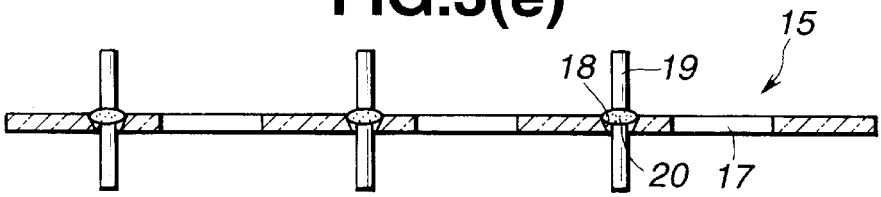

The embodiments according to the present invention will now be described below in detail with reference to the attached drawings. FIG. 1 is a side cross-sectional view partially illustrating a hermetic container for a field emission type display according to the present invention. FIG. 2 is an enlarged perspective view partially illustrating a hermetic container supporting member arranged within the container of the field emission type display shown in FIG. 1.

In the container 1 acting as a hermetic container for a field emission type display, the anode substrate 2 is spaced from the cathode substrate 3 a predetermined distance apart. The space between the fringe portion of the anode substrate 2 and the fringe portion of the cathode substrate 3 is sealed with, for example, a low softening point glass of about 400° C. The space between the anode substrate 2 and the cathode substrate 3 is set to, for example, 1 mm. In this embodiment, the field emission type display is driven on at least an anode voltage of 1 kV higher than that for the conventional field emission type display.

The anode substrate 2 is formed of a transparent insulating rectangular plate. Dot-like fluorescent substance layers 5 are coated on positions confronting field emission elements 7 (to be described later) on an inner surface of the anode substrate 2. Anode conductors 4 formed of a metal thin film such as aluminum are formed on the upper surfaces of the fluorescent substance layers 5. The display section 6 acting as an anode is formed of the anode conductor 4 and the fluorescent substance layer 5.

The cathode substrate 3 is formed of the insulating plate for the anode substrate 2. Vertical field emission elements 7 acting as electron sources in the display section 6 are formed on the inner surface of the cathode substrate 3.

The field emission element 7, as shown in FIG. 1, includes a cathode electrode 8 formed on the inner surface of the cathode substrate 3, an insulating layer 9 of a silicon dioxide formed on the cathode electrode 8, a gate electrode 10 formed on the insulating layer 9, and a cone emitter 12 formed on the cathode electrode 8 within the hole 11 formed in the insulating layer 9 and the gate electrode 10.

In some field emission elements, a resistance layer is formed between the cathode electrode 8 and the insulating layer 9. The fluorescent substance layer 5 confronting the intersection of the cathode electrode 8 and the gate electrode 10 can be selectively glowed by arranging the cathode electrodes 8 and the gate electrodes 10 in the field emission element 7 in a matrix form and directly coating the fluorescent substance layer 5 on the inner surface of the container 1.

A supporting member 15 (15A), as shown in FIG. 1, is disposed within the container 1 to internally support the anode substrate 2 and the cathode substrate 3 and to maintain the space between the anode substrate 2 and the cathode substrate 3 to a fixed distance. The supporting member 15 is formed of a rectangular plate 16 such as a transparent glass plate, ceramic plate, or a metal plate.

A through window 17 is formed in the plate 16 so as to correspond to the pixel (or the rectangular pixel in the example shown in FIG. 1) of the display section 6 at the position confronting the fluorescent substance layer 5. The through window 7 is formed in the pattern of the display portion 6 so as not to disturb the trajectory of electrons for the luminous display. In concrete, the though window 17 is defined in a rectangular form as shown in FIG. 2.

Tapered through holes 18 (hereinafter referred to as through holes) each for positioning a support (or pillar) are formed at predetermined intervals so as to avoid the through holes 17 in the plate 17. Referring to FIG. 2, through holes 18 are formed near to the shorter sides of the through windows 18. The through holes 18 are lined at intervals of L1. The lines of the through holes 18 are arranged side by side at intervals of L2. The reinforcing supports 19 each formed of an insulating member such as glass fiber and having the same length penetrate the through holes 18 respectively. In each reinforcing support 19, the longitudinal middle portion is securely bonded at the through hole 18 with a fixing agent 20.

It is not needed that the reinforcing support 19 exhibits an insulating property. The reinforcing support 19 may have its ends formed of an insulating member and the remaining portion formed of a metal.

The supporting member 15 is disposed inside the container 1 while the reinforcing supports 19 have one ends 19*a* in contact with the inner surface of the anode substrate 2 and the other ends 19*b* in contact with the cathode substrate 3. This configuration can internally support the anode substrate 2 and the cathode substrate 3 to maintain the gap between the anode substrate 2 and the cathode substrate 3 to a fixed value, thus preventing the container 1 from being deformed due to the atmospheric pressure.

In the field emission display with the above-mentioned configuration, electrons emitted from the field emission element 7 pass through the through window 17 of the supporting member 15 and then hit and glow the fluorescent substance layer 5 in an excited state. The glowing is observed through the transparent anode substrate 2.

Next, the method of fabricating the supporting member 15 to be housed in the container 1 of the field emission type display will be described below with reference to FIGS. 3(*a*) to 3(*e*).

The special jig 21 shown in FIG. 3(*b*) is used to fabricate the supporting member 15. The jig 21 consists of a base plate 23 and a suction apparatus 25. The base plate 23 has through holes 22 at the portions which correspond to through holes 18 formed in the plate 16 of the supporting member 15. Each of holes 22 has a diameter larger than each through hole 18. The reinforcing supports 19 are inserted into the through holes 18 and the holes 22. The suction apparatus 25 sucks the reinforcing supports 18 through the surface 24*a* of the porous plate 24 disposed on the base plate 23 to hold them.

In order to form the supporting member 15, through holes 18 for positioning the reinforcing supports in the rectangular plate 16 and through holes 17 corresponding to pixels of the display portion 6 are first formed in an etching process, as shown in FIG. 3(*a*). Next, as shown in FIG. 3(*b*), the plate 16 is closely placed on the surface 23*a* of the base plate 23 of the jig 21 so as to align the through holes 18 of the plate 16 with the holes 22. Then the reinforcing supports 19 are inserted into the through holes 18 respectively. Each reinforcing support 19 is further inserted into the hole 22 in such a manner that the end (the other end 19*b*) thereof is in contact with the surface 24*a* of the porous plate 24. In such a condition, the suction apparatus 25 sucks and holds the other end 19*b* of each reinforcing support 19 on the surface 24*a* of the porous plate 24.

The height of the base plate 23 is adjusted in such a manner that the middle portion of each reinforcing support 19 is in the through hole 18. Thus, the height of each reinforcing support 19 protruded from the plate 16 is defined. Plural reinforcing supports 19 are inserted into the through holes 18 correspondingly. The reinforcing supports 19 are arranged on the plate 16 with the middle portions of them respectively positioned at the through holes 18. In this case, since the base plate 23 covers the through windows 17 in the plate 16, the reinforcing supports 19 inserted into the through windows 17 are not sucked by the suction apparatus in operation.

Next, as shown in FIG. 3(*c*), each reinforcing support 19 is securely fixed at the inlet of the through hole 18 of the plate 16 by applying a fixing agent with a dispenser. At this time, the sucking force of the suction apparatus 25 is weakened to prevent the fixing agent 20 from being sucked into the through hole 18. A paste substance of a mixture of a photosensitive acrylic resin and a low softening point glass may be used as the fixing agent 20.

Next, as shown in FIG. 3(*d*), ultraviolet rays are irradiated onto the plate 16 on which the fixing agent has been completely coated to harden the fixing agent 20. Thereafter, the suction apparatus 25 is deactivated. The plate 16 is taken off from the jig 21. Thus, a supporting member 15 to which plural reinforcing supports 19 have been securely fixed on the single plate 16 is completed as shown in FIG. 3(*e*).

The container 1 may be fabricated in a similar manner to that of the conventional art. That is, after hardening of the fixing agent 20, one ends 19*a* of the reinforcing supports 19 are securely fixed on the anode substrate 2 with a fixing agent. Thereafter, a fixing agent is coated on the other ends 19*b* of the reinforcing supports 19 and on the fringe portion of the anode substrate 2. The other ends 19*b* of the reinforcing supports 19 are securely fixed on the cathode substrate 3. At the same time, the fringe portion of the anode substrate 2 is securely fixed with the fringe portion of the cathode substrate 3.

Figure 4:
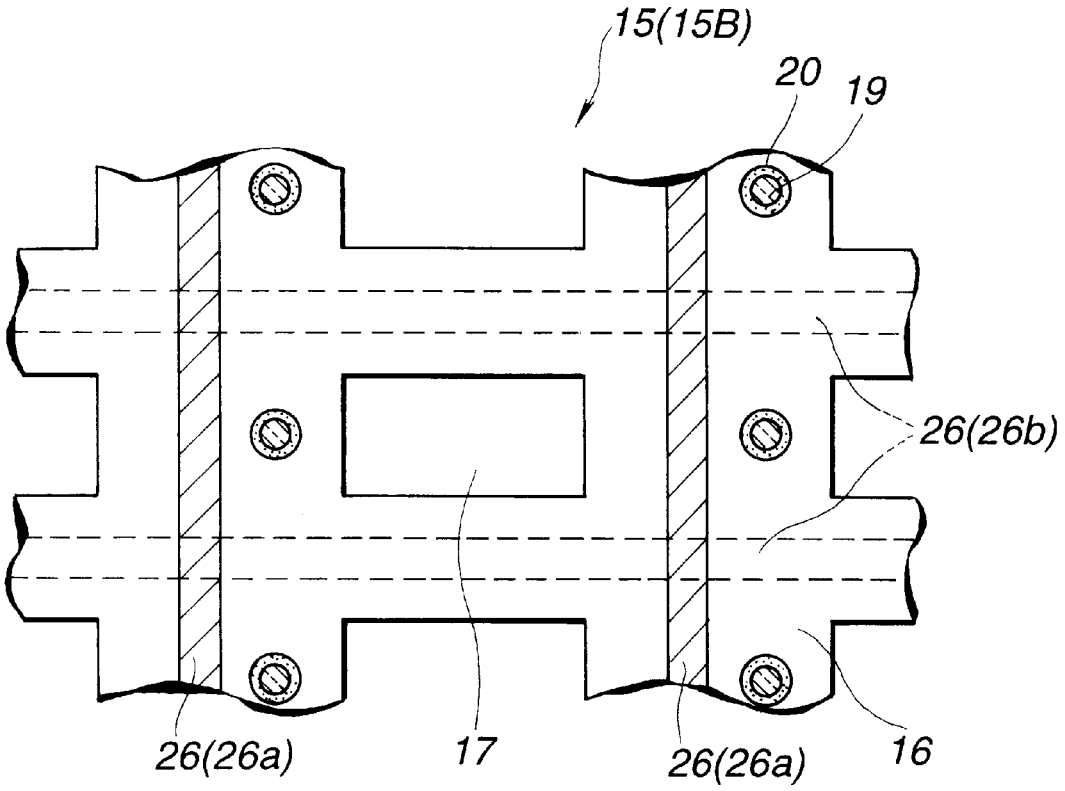
FIG. 4 is an enlarged plan view partially illustrating the supporting member for a hermetic container according to the second embodiment of the present invention.
Figure 5:
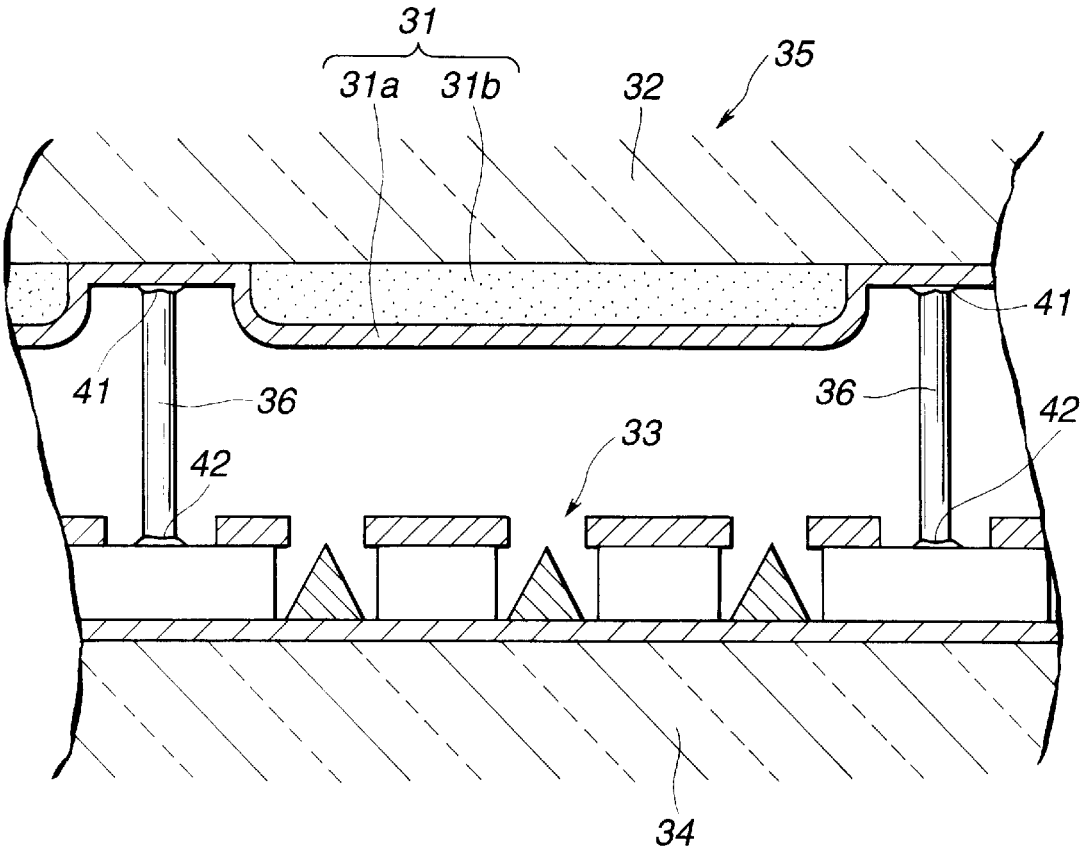
FIG.5 (PRIOR ART)
FIG. 5 is a side cross-sectional view partially illustrating a conventional field-emission-type display including reinforcing supports.
Figure 6:
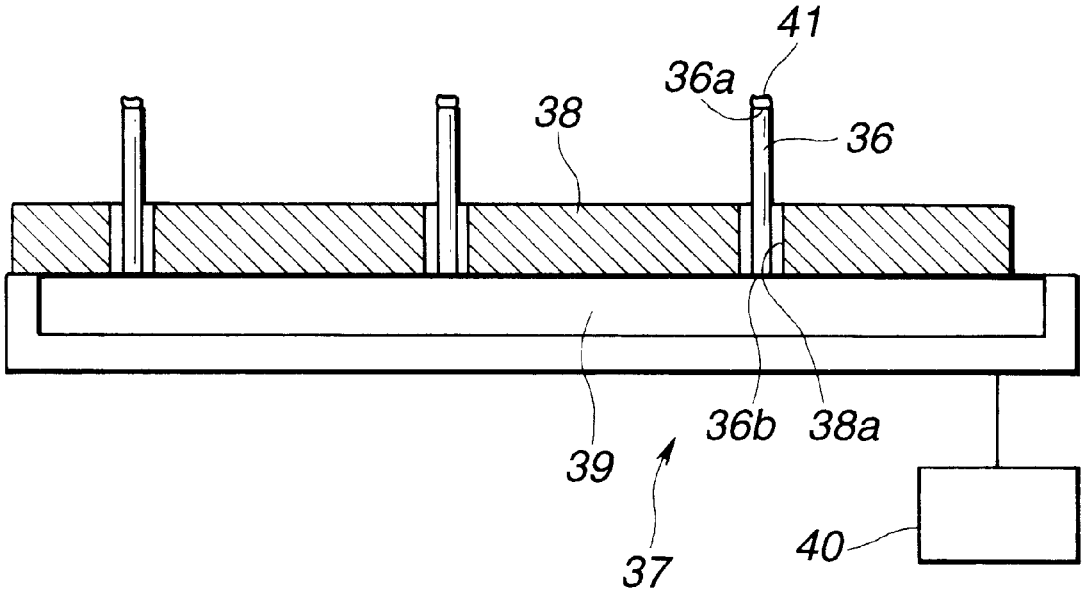
FIG.6 (PRIOR ART)
FIG. 6 is an explanatory diagram for explaining a method of arranging reinforcing supports used in the field-emission-type display shown in FIG. 5.

FIG. 4 is an enlarged plan view illustrating a hermetic container supporting member according to the second embodiment of the present invention. Like numerals are attached to the same constituent elements as those for the supporting member in the first embodiment. Hence, the duplicate description will be omitted here.

In the second embodiment, the supporting member 15 (15A) consists of a plate 16 formed of an insulating plate such as a glass plate or a ceramic plate. Electrodes 26 of a conductive metal such as aluminum are formed on the plate 16. In concrete, as shown in FIG. 4, strip electrodes 26*a* run in parallel along the short side of the through window 17 on the surface 16*a* of the plate 16 so as sandwich the through window 17. Strip electrodes 26*b* formed on the back surface 16*b* of the plate 16 may be formed so as to be perpendicular to the electrodes 26*a* formed on the surface 16*a* of the plate 16 and so as to sandwich each through window 17.

In the second embodiment, by applying an electric field between two electrodes 26 arranged along both sides to the through window 17 and formed on the front surface 16*a* or back surface 16*b* of the plate 16 or between two electrodes 26 arranged along both sides of the through window 17 and formed on the front surface 16*a* and the back surface 16*b* of the plate 16, they act as a control electrode that focuses or diverges electrons emitted from the field emission element through the through window 17 on the display portion 67.

In the embodiment shown in FIG. 4, the strip electrodes 26*a* are formed on the front surface 16*a* of the plate 16 while the strip electrodes 26*b* are formed on the back surface 16*b* of the plate 16. The strip electrodes 26*a* is perpendicular to the strip electrodes 26*b*. However, the strip electrodes 26 may be formed only on the front surface 16*a* or back surface 16*b* of the plate 16.

In the supporting member according to the above-mentioned embodiment, all reinforcing supports 19 is integrally formed to a sole plate 16 by securely bonding the middle portion of each reinforcing support 19 at the corresponding through hole 18. Hence, the integrated structure can sufficiently reduce the displacement of each reinforcing supports 19 and can improve the stress resistance and the buckling strength, compared with the conventional structure. This structure can stably maintain the space between the anode substrate 2 and the cathode substrate 3 forming the container 1 and can prevent the container 1 from being deformed due to the atmospheric pressure.

The supporting member 15 can be fabricated independently of the producing process of the anode substrate 2 and the cathode substrate 3. The supporting member 15 can be built in the container 1 at the final fabrication step. Hence, the step of forming the supporting member 15 does not adversely affect the other steps.

The supporting member 15 is formed of a plate 16 of an insulating material and has at least one surface on which electrodes 26 are formed. When an electric field is applied between two electrodes 26 between which the through window 17 is disposed, electrons emitted from the field emission element 7 can be controllably accelerated to focus or diverge on the display portion 6 through the through window 17.

The plate 16 acting as the supporting member 15 may be formed of a metal plate. Electrons emitted from the field emission element 7 are controllably accelerated by applying a fixed voltage to the plate 16 to focus or diverge on the display portion 6 through the through window 17. Moreover, the anode driven by a high voltage can be shielded from the cathode driven by a low voltage by applying a fixed voltage to the plate 16. Since electrons emitted from the field emission element 7 pass through the through window (opening) 17 having the same shape as the display dot, an image can be clearly displayed in a dot unit.

Where part of the plate 16 forming the supporting member 15 is formed of an alloy containing Zr or a thin film alloy containing Zr is formed on the surface of the plate 16, the supporting member 15 can have a gettering function. The Zr alloy can adsorb gasses existing in the container, thus preventing the display portions 6 and the field emission elements 7 from being contaminated due to residual gases and improving the degree of vacuum in the container.

In the above embodiments, the field emission type display has been described as a hermetic container. However, it should be noted that the present invention is not limited only to the embodiments if the container having a thin hermetic structure in a high vacuum state is needed. For example, the hermetic container may be used for vacuum micro magnetic sensors, high-speed switching elements, image pickup elements, readers and so on.

As clearly understood from the above description, the present invention has an integrated structure in which all reinforcing supports are bonded together by a simple plate and the middle portions of the reinforcing supports are securely fixed at the inlets of through holes in the plate. Hence, the displacement of each reinforcing support can be sufficiently decreased. Compared with the conventional structure, the structure according to the present invention can be improve the stress resistance and the buckling strength. Thus, the space between the anode substrate and the cathode substrate forming a container can be maintained stably while deformation of the container due to the atmospheric pressure can be prevented.

According to the present invention, the plate acting as a supporting member is formed of an insulating member having at least one surface on which electrode are formed. By applying an electric field between two electrodes arranged on both sides of the transparent portion, electrons emitted from the electron source can be controllably accelerated to focus or diverge on the display section through the transparent window.

Furthermore, according to the present invention, the plate acting as a supporting member is formed of a metal member. Hence, by applying a fixed potential to the plate, electrons emitted from the electron source are controllably accelerated to focus or diverge on the display section through the through window. The plate can shield the anode driven on a high voltage from the cathode driven on a low voltage.

According to the present invention, part of the plate forming the supporting member is formed an alloy containing Zr or a thin film alloy containing Zr is formed on the surface of the plate. Since the Zr alloy has a gettering function, it can adsorb gases remaining in the container and can prevent the display portions and the electric field elements from being contaminated by residual gases so that the degree of vacuum in the container can be improved.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A hermetic container supporting member contained and arranged in a hermetic container to support on the inside of said hermetic container, comprising:

a plate having plural through holes arranged at a predetermined intervals and through windows each passing electrons; and reinforcing supports respectively inserted into said through holes, each of said reinforcing supports having an axial center portion securely fixed at a corresponding through hole and both ends being in contact with inner surfaces of said hermetic container.

2. A hermetic container supporting member contained and arranged in a hermetic container to support on the inside of said hermetic container, said hermetic container containing an anode substrate having an inner surface on which a display portion is formed and a cathode substrate having an electron source on the inner surface confronting said display portion of said anode substrate, said anode substrate being spaced from said cathode substrate a predetermined distance apart, said anode substrate and said cathode substrate being sealed at the fringe portions of said anode and cathode substrates, comprising:

a plate having plural through holes arranged at predetermined intervals and through windows each passing electrons emitted from a corresponding electron source; and reinforcing supports respectively inserted into said through holes, each of said reinforcing supports having an axial center portion securely fixed at a corresponding through hole and both ends being in contact with an inner surface of said anode substrate and an inner surface of said cathode substrate.

3. The hermetic container supporting member as defined in claim 2, wherein said plate comprises an insulating member, said plate on which strip electrodes are formed on at least one surface thereof so as to sandwich a corresponding through window, said strip electrodes focusing and diverging electrons emitted from an electron source when an electric field is applied between strip electrodes.

4. The hermetic container supporting member as defined in claim 2, wherein said plate comprises a metal member.

5. The hermetic container supporting member as defined in claim 1, wherein said plate partially comprises an alloy containing Zr, or has an alloy film containing Zr on the surface thereof.

6. The hermetic container supporting member as defined in claim 2, wherein said plate partially comprises an alloy containing Zr, or has an alloy film containing Zr on the surface thereof.

7. The hermetic container supporting member as defined in claim 4, wherein said plate partially comprises an alloy containing Zr, or has an alloy film containing Zr on the surface thereof.

8. A hermetic container comprising:

an anode substrate having an inner surface on which an anode conductor and a display portion of a fluorescent substance layer are formed;

a cathode substrate having an inner surface on which field emission cathodes are formed, said inner surface confronting said display portion on said anode substrate, said cathode substrate being spaced from said anode substrate a predetermined distance apart, said anode substrate and said cathode substrate being sealed at the fringe portions of said anode and cathode substrates; and a supporting member arranged between said anode substrate and said cathode substrate;

said supporting member including a plate and reinforcing supports, said plate having plural through holes arranged at predetermined intervals and through windows each passing electrons emitted from a corresponding field emission cathode, and said reinforcing supports respectively inserted into said through holes, each of said reinforcing supports having an axial center portion securely fixed at a corresponding through hole and both ends being in contact with an inner surface of said anode substrate and an inner surface of said cathode substrate.

* * * * *